US010364553B2

(12) United States Patent
Snyder

(10) Patent No.: US 10,364,553 B2
(45) Date of Patent: Jul. 30, 2019

(54) WEAR ASSEMBLY FOR EARTH WORKING EQUIPMENT

(71) Applicant: ESCO Corporation, Portland, OR (US)

(72) Inventor: Christopher D. Snyder, Portland, OR (US)

(73) Assignee: ESCO GROUP LLC, Portland, OR (US)

( * ) Notice: Subject to any disclaimer, the term of this patent is extended or adjusted under 35 U.S.C. 154(b) by 26 days.

(21) Appl. No.: 15/426,461

(22) Filed: Feb. 7, 2017

(65) Prior Publication Data

US 2017/0226718 A1 Aug. 10, 2017

Related U.S. Application Data

(60) Provisional application No. 62/292,490, filed on Feb. 8, 2016.

(51) Int. Cl.
*E02F 9/28* (2006.01)

(52) U.S. Cl.
CPC ..... *E02F 9/2833* (2013.01); *E02F 9/2841* (2013.01); *E02F 9/2875* (2013.01)

(58) Field of Classification Search
CPC ..... A01B 13/08; E02F 9/2825; E02F 9/2833; E02F 9/2841; E02F 9/2883; E02F 9/2875
USPC ..... 37/446, 449, 452–460; 172/699, 172/701.1–701.3; 403/153, 297, 320, 355
See application file for complete search history.

(56) References Cited

U.S. PATENT DOCUMENTS

| | | | | |
|---|---|---|---|---|
| 3,191,323 | A | 6/1965 | Compagnoni | |
| 3,997,989 | A | 12/1976 | Stepe | |
| 4,027,408 | A | 6/1977 | Ramella et al. | |
| 5,009,017 | A | 4/1991 | Diekevers et al. | |
| 5,918,391 | A | 7/1999 | Vinas Peya | |
| 6,574,892 | B2 * | 6/2003 | Creighton | E02F 9/2833 37/456 |
| 6,959,506 | B2 | 11/2005 | Adamic et al. | |
| 6,976,325 | B2 * | 12/2005 | Robinson | E02F 9/2825 37/456 |
| 7,032,334 | B2 | 4/2006 | Pippins | |
| 7,162,818 | B2 | 1/2007 | Ruvang et al. | |
| 7,640,684 | B2 | 1/2010 | Adamic et al. | |
| 7,762,015 | B2 | 7/2010 | Smith et al. | |
| 7,788,830 | B2 | 9/2010 | Woerman | |
| 8,434,248 | B2 | 5/2013 | Woerman et al. | |
| 8,555,532 | B2 | 10/2013 | Lopez Almendros et al. | |
| 8,770,311 | B2 | 7/2014 | Rivera et al. | |
| 9,074,351 | B2 | 7/2015 | Ballinger | |
| 10,030,368 | B2 * | 7/2018 | Vegunta | E02F 9/2825 |
| 2007/0107274 | A1 | 5/2007 | Livesay et al. | |

(Continued)

FOREIGN PATENT DOCUMENTS

| | | |
|---|---|---|
| EP | 1852557 | 8/2008 |
| WO | WO 2013/082678 | 6/2013 |

*Primary Examiner* — Robert E Pezzuto
(74) *Attorney, Agent, or Firm* — John Anderton

(57) ABSTRACT

A wear assembly for earth working equipment includes a base, a wear member and a lock. The lock includes a retainer and a lock body. The retainer is seated in a recess in the base. A key of the retainer is received in the keyway of the wear member as the cavity receives the base. A lock body passes through aligned openings of the base, retainer and wear member to engage the retainer and secure the wear member to the base.

6 Claims, 9 Drawing Sheets

(56) References Cited

U.S. PATENT DOCUMENTS

2012/0055052 A1* 3/2012 Campomanes ..... E02F 9/2825
37/456

* cited by examiner

WEAR ASSEMBLY FOR EARTH WORKING EQUIPMENT

FIELD OF THE INVENTION

The present invention pertains to a wear assembly for earth working equipment.

BACKGROUND OF THE INVENTION

In mining and construction, wear parts (e.g., teeth) are commonly provided to protect the underlying equipment from undue wear and break up the ground in a digging operation such as with an excavating bucket, ripper arm or the like. Teeth typically encounter heavy loading and highly abrasive conditions during use and must be periodically replaced. A lock that can be released and installed quickly is desirous as replacement of the points requires downtime for the earthmoving equipment, which can cause a significant loss of production.

A tooth system typically includes a base or adapter attached to the excavating equipment, and a point or tip secured to the base to contact the ground. A lock is used to secure the point to the base. The reliable lock is desirous. Failure of the lock can result in loss of the point, damage to the base, and/or jamming or damage to downstream processing equipment such as a crusher.

SUMMARY OF THE INVENTION

The present invention pertains to a wear assembly for earth working equipment that includes a wear member secured to a base by a lock.

In one embodiment, a ground-engaging wear member for earth working equipment comprises a front working portion and a rear mounting portion. The rear mounting portion includes a rear end and a cavity that opens rearward in the rear end for receiving a base on the earth working equipment. The base has an opening that extends transversely through the base, and a recess about the opening on one wall of the base for receiving a retainer of a lock to secure the wear member to the base. The cavity has cavity walls wherein at least a first of the cavity walls including (i) a hole extending through the slot for receiving a lock body to engage the retainer, and (ii) a slot that opens in the rear end and in the hole to receive a key of a lock retainer. The slot includes a pair of spaced bearing surfaces to bear against complementary surfaces on the key to prevent turning of the retainer in the recess.

In one embodiment, a wear assembly for earth working equipment comprises a ground-engaging wear member and a lock to secure the wear member to the equipment. The wear member includes (i) a cavity having top, bottom and side walls for receiving a base on the earth working equipment, (ii) a hole in each said sidewall, and (iii) a slot in at least one of the side walls of the cavity. The lock includes a retainer received in the recess in the base, and a lock body. The retainer has a central opening generally aligned with the opening in the base and a key received into the slot. The lock body extends through the central opening in the retainer and into each hole in the wear member to hold the wear member to a base on the equipment. The lock body and central opening have fastening elements that engage each other to connect the lock body to the retainer. In one embodiment the wear assembly engages the ground moving in one direction.

In one embodiment, a lock for securing a wear member to a base on earth working equipment includes a retainer and a lock body. The retainer has a body with a first face and a second face, a threaded hole opening to the first and second faces, and an outwardly projecting ridge on the second face. The lock body has a thread to engage the threaded hole in the retainer, and a tool receiving formation to facilitate turning of the lock body.

In one embodiment, a method of installing a ground-engaging wear member on earth working equipment comprises placing a retainer in a recess on a base on the earth working equipment where the retainer has a key and a central hole, fitting the wear member over the base such that the base is received into a cavity in the wear member where the key is received into a slot in the cavity and at least one hole in the wear member generally aligns with an opening extending through the base, inserting a lock body through the at least one hole in the wear member and the opening in the base, and securing the lock body in the central hole in the retainer.

In one embodiment, a lock can include an elongate lock body and a retainer with an opening to receive the lock body. The retainer mounts in a recess of a base and includes an extending key to be received in a keyway of the wear member. The lock body and retainer can include corresponding fasteners with engaging elements such as lugs or threads. As the adapter seats in a cavity of the wear member, an opening in the adapter aligns with one or more openings in the wall of the wear member. The lock body is received through the aligned openings to engage the retainer.

In some embodiments, a lock has a limited number of parts, is inexpensive to manufacture, can provide double shear retention for reliability, provides a dependable system for securing wear members to earth working equipment, resists binding from fines and accidental loss of the wear member during operations, and/or provides rapid replacement of the wear member and installation of a replacement part at the end of its service life reducing operating costs.

In accordance with one embodiment of the invention, a retainer for a wear member lock is held in adjacent recesses of a wear member and a base.

In accordance with one embodiment of the invention, a lock body engages a retainer in a cavity formed by recesses in a base and a wear member.

In accordance with one embodiment of the invention, a wear member moves through the earth in one direction.

In accordance with one embodiment of the invention, a method for installing a wear member lock includes inserting a retainer in a recess of a base, and mounting a wear member by accepting a nose of the adapter in a cavity of the wear member and receiving a portion of the retainer in a wall slot of the cavity to limit rotation of the retainer in the recess.

In accordance with one embodiment of the invention, a seat to receive a retainer is defined by a recess in each of a base and a wear member. Seating the adapter in the wear member defines the retainer seat.

To gain an improved understanding of the advantages and features of the invention, reference may be made to the following descriptive matter and accompanying figures that describe and illustrate various configurations and concepts related to the invention.

DETAILED DESCRIPTION OF PREFERRED EMBODIMENTS

Figure 1:
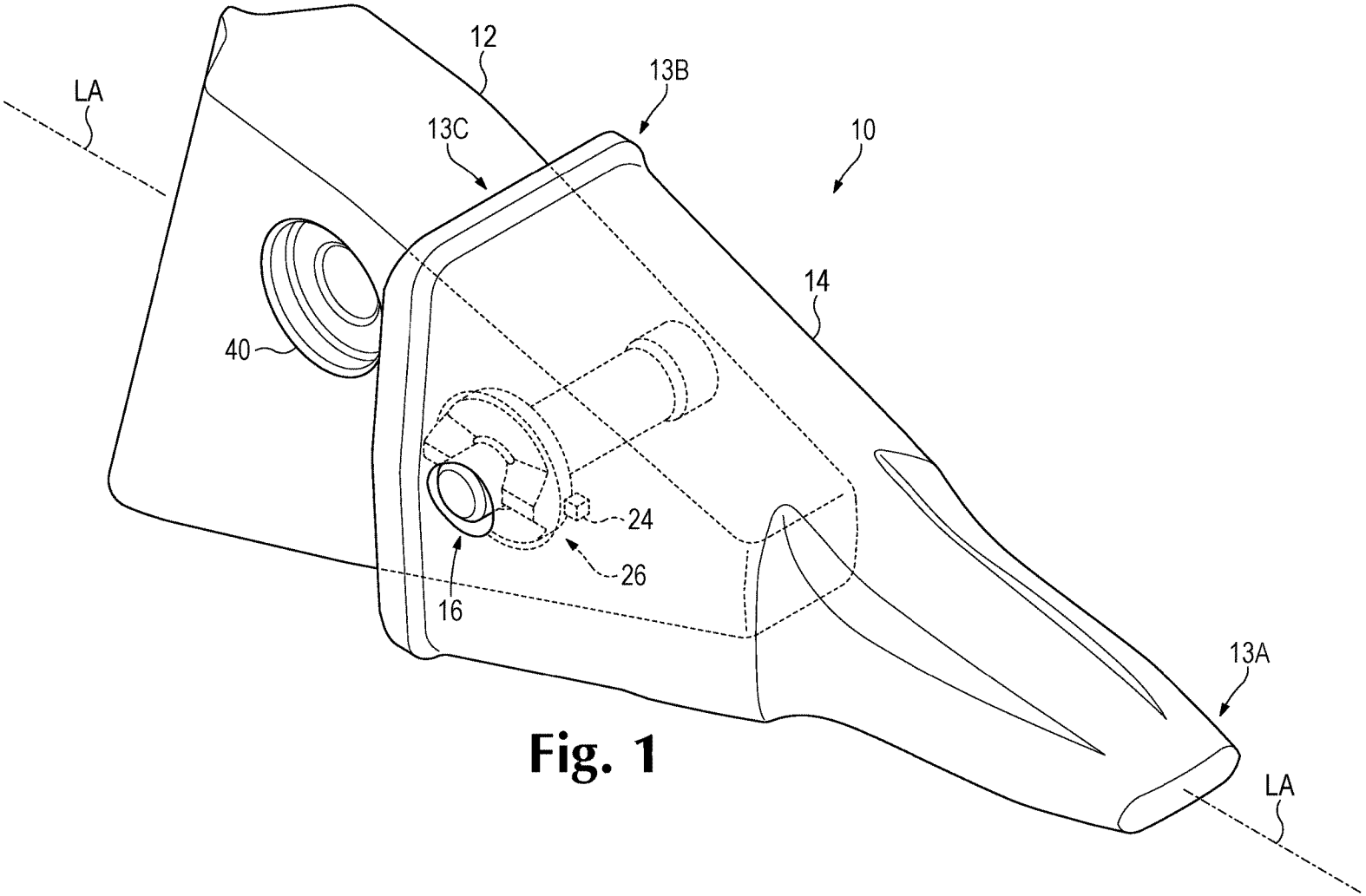
FIG. 1 is a perspective view of one embodiment of a wear assembly in accordance with the present invention.
Figure 2:
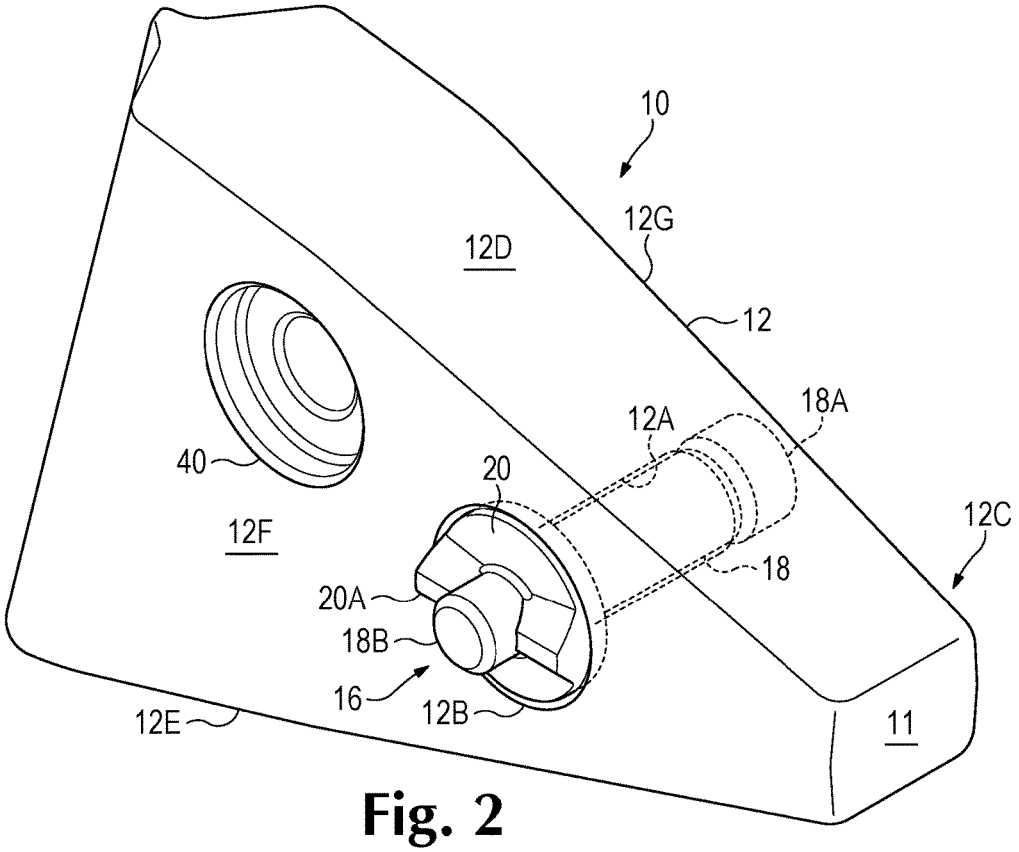
FIG. 2 is a front perspective view of a base and lock of the wear assembly.

Wear members secured to earth working equipment are commonly attached to a base on the equipment to engage earthen materials during operation. As examples, the earth working equipment can be a bucket, a ripper arm, cutter head or other kinds of equipment for digging, moving or otherwise working the ground. The base can be secured to the equipment by, for example, welding or mechanical attachment, or could be a cast formation in a component of the equipment such as a lip of a bucket. Wear members could also be secured directly to the earth working equipment (e.g., directly to a ripper arm) without a separate base. In such a case, the equipment itself that mounts the wear member is considered the base. In any event, the wear member is secured to the base by a lock system 9 that can be released or removed to permit replacement of the wear member when it is worn out. The wear member can, for example, be a point or tip, shroud, runner, etc. While the present invention can be used in a wide variety of wear parts and operations, one embodiment of the present invention is shown as a ripper tooth in FIGS. 1-8. In this embodiment, the wear assembly 10 includes a wear member 14 secured to a base 12 by a lock 16.

Base 12 includes a rear end welded to a ripper arm, though other arrangements are possible, and a forwardly projecting nose 12C that generally tapers toward front end 11 with converging top and bottom walls 12D, 12E. Front end 11 can be a transverse thrust surface. Base 12 includes an opening 12A and an associated recess 12B. Opening 12A is, in this embodiment, a cylindrical hole that extends transversely through the nose 12C and opens in opposite sidewalls 12F, 12G. The recess 12B is generally adjacent and/or coaxial with the opening 12A forming a countersink formation in one sidewall 12F of the nose. This is a conventional base design in common use today for rippers and other excavating teeth. The conventional tooth includes a point with a cavity to receive the nose 12C and support the point on the equipment. A hole in each sidewall of the point aligns with the opening 12A in nose 12C. A split ring is set in recess 12B and trapped between the point sidewall and nose sidewall. A cylindrical pin with annular groove is hammered into the aligned sidewall holes and nose opening until the slit ring is received into the groove in the pin.

While the wear assembly 10 of the present invention can be used in first fit applications, it is well suited for use in connection with this conventional base to provide an improved attachment of points and/or permit the attachment of other point designs. For example, a locking system 16 in accordance with the present invention can be reliable and strong to lessen the risk of point loss, easy and quick for efficient replacement of worn wear members, hammerless for improved safety, inexpensive to manufacture, involve a few simple parts, and/or is usable to secure aftermarket points to conventional in-use bases.

Wear member 14 includes a front working portion 13A and a rear mounting portion 13B with a rear end 13C and a cavity 14A opening rearward in the rear end 13C. In this embodiment, the front working portion 13A is the bit of a point for an excavating tooth. An opening or hole 14B extends through one or both of opposing cavity walls 15, 17. The wear member preferably includes a hole 14B in each of the opposing sidewalls as shown in the drawings. Nevertheless, other arrangements such as providing only a single hole 14B in one sidewall, and/or a vertical orientation of the lock with a hole in one or both of the top and bottom cavity walls. The nose 12C is received in cavity 14A along a wear member axis LA, although other configurations are possible, to mount and support the wear member on the earth working equipment. Cavity 14A preferably has a configuration to complement nose 12C. The complementary shapes of the base 12 and cavity 14A could be considerably different for ripper teeth or for other wear members for ripper or other earth working operations.

A recess 12B can be provided in each sidewall 12F, 12G (or walls 12D, 12E) for reversibility if desired. With base 12 seated in the cavity 14A of wear member 14, opening 12A aligns with holes 14B of the wear member. Base 12 can include additional openings 40 for attaching additional wear members such as a shroud for the arm. This is the arrangement of the conventional ripper bases. The same, similar or different locking arrangement can be used to secure such other wear members.

As the base wears with use, the nose can become effectively shorter and/or narrower. A wear member receiving the worn nose in the cavity can sit farther back on the base than occurs with a base without wear. The one or more holes 14B in the cavity walls can be extended or elongated to form a slot. The elongated hole can align with opening 12A over a range of forward/rearward wear member positions to accept the lock and secure the wear member.

Lock 16 is received in the aligned holes 12A, 14B of the wear member and base to secure them together. Lock 16 includes a pin or lock body 18 with a fastening element 18D, which can be a helical element or other thread structure, and a retainer 20 with opening 20B with a corresponding fastening element 20C such as a helical element. Fastening elements are described here as threads as one example, but they could include other arrangements that perform the same or similar function. One other example could include lugs and grooves for a bayonet mount along with a detent or clip to inhibit unintended release. In the illustrated embodiment, the thread extends at least one full rotation around the lock body, though other fastening or helical elements can extend only partially around the circumference of the lock body. The retainer 20 can be a nut or retention ring. The retainer and body in some embodiments are not threaded and the retainer acts as a push-on fastener or secured by another retention function.

Each of the lock body 18 and retainer 20 includes a longitudinal axis LA1 and LA2 that coincide when the lock body is assembled to the retainer, though they need not if the recess is eccentric to the opening through the nose. Proximal end 18A can include a tool engagement feature 18C such as a hex socket or hex head to receive a corresponding torque tool to facilitate rotation of the lock body to, in this embodiment, thread and unthread the lock body 18 into and out of retainer 20. A tool receiving formation 18C can be provided on the distal end 18B or both ends of the lock body.

The lock body can optionally be tapered to converge from a proximal end 18A towards distal end 18B. Similarly, the helical threads can taper to a smaller diameter extending axially. A tapered lock body 18 can make for easier release of the lock body from the aligned openings 12A, 14B when compacted fines are present in the wear assembly 10. Fines are small particles that can collect in crevices and compact during operations to form cement-like compactions in ground-engaging wear parts. Where the lock body is axially tapered, the first rotation and axial movement of the lock body (e.g., with a threaded connection) in relation to the wear member and base creates a gap between the lock body and any compacted fines. Tapering of the lock elements and/or helical element can make it easier to overcome the binding of the assembled parts caused from fines. When removing the lock, as the lock body rotates and displaces axially from the retainer, a gap forms between the lock body and the fines, which increases with further lock body rotation. The gap enables the lock body to turn and be withdrawn from openings 12A, 14B more easily. Without such a taper, the fines would tend to continue to bind the lock body and frictionally resist withdrawal of the lock body from the openings 12A, 14B. Such benefits of a tapered lock can be gained even if the openings 12A and/or 14B are not tapered. The opening 12A is not tapered in the conventional ripper base. Nevertheless, opening 12A and/or openings 14B could be tapered to complement the taper of the lock body 18.

Figure 3:
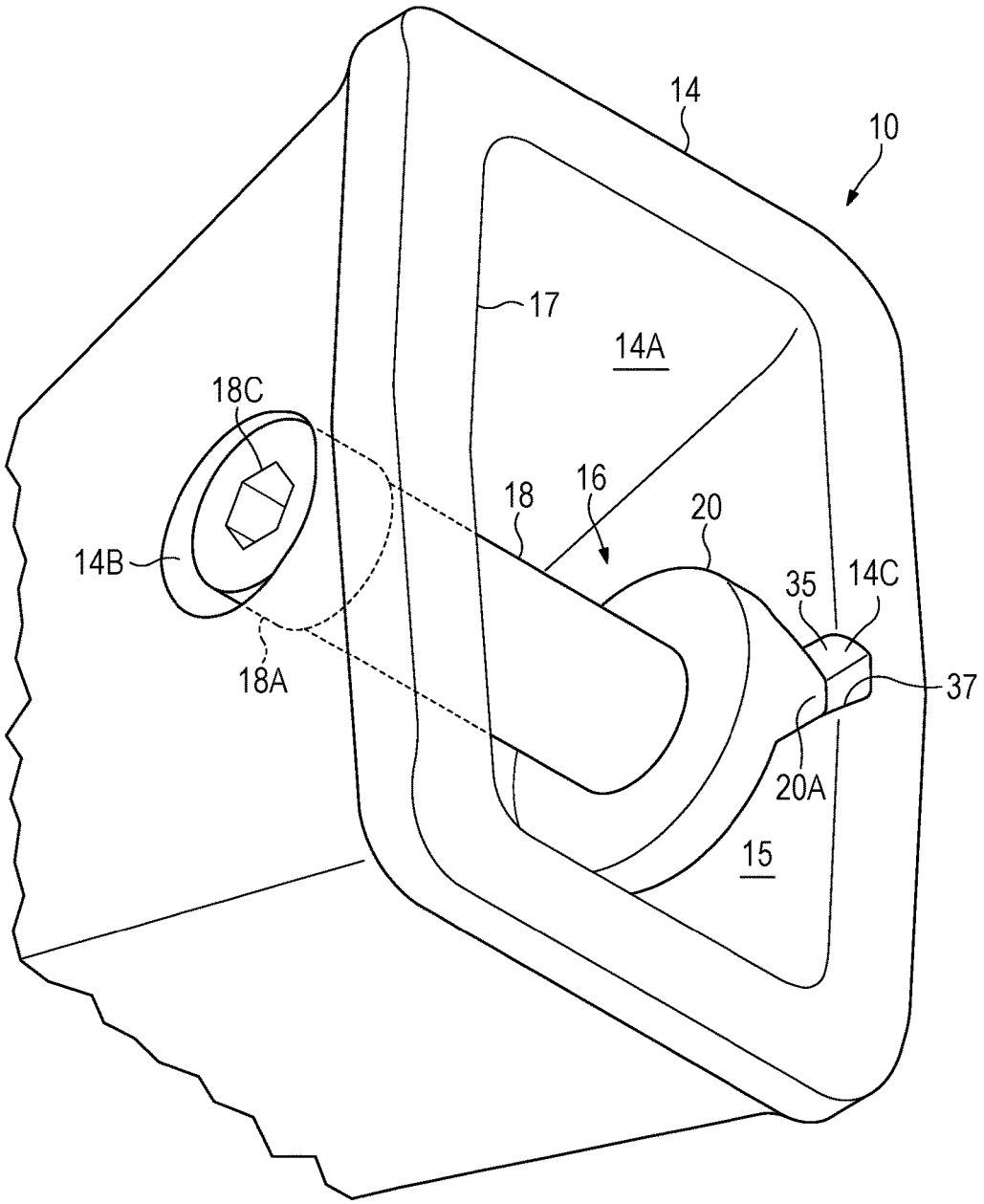
FIG. 3 is a rear perspective view of a wear member and lock of the wear assembly.
Figure 3A:
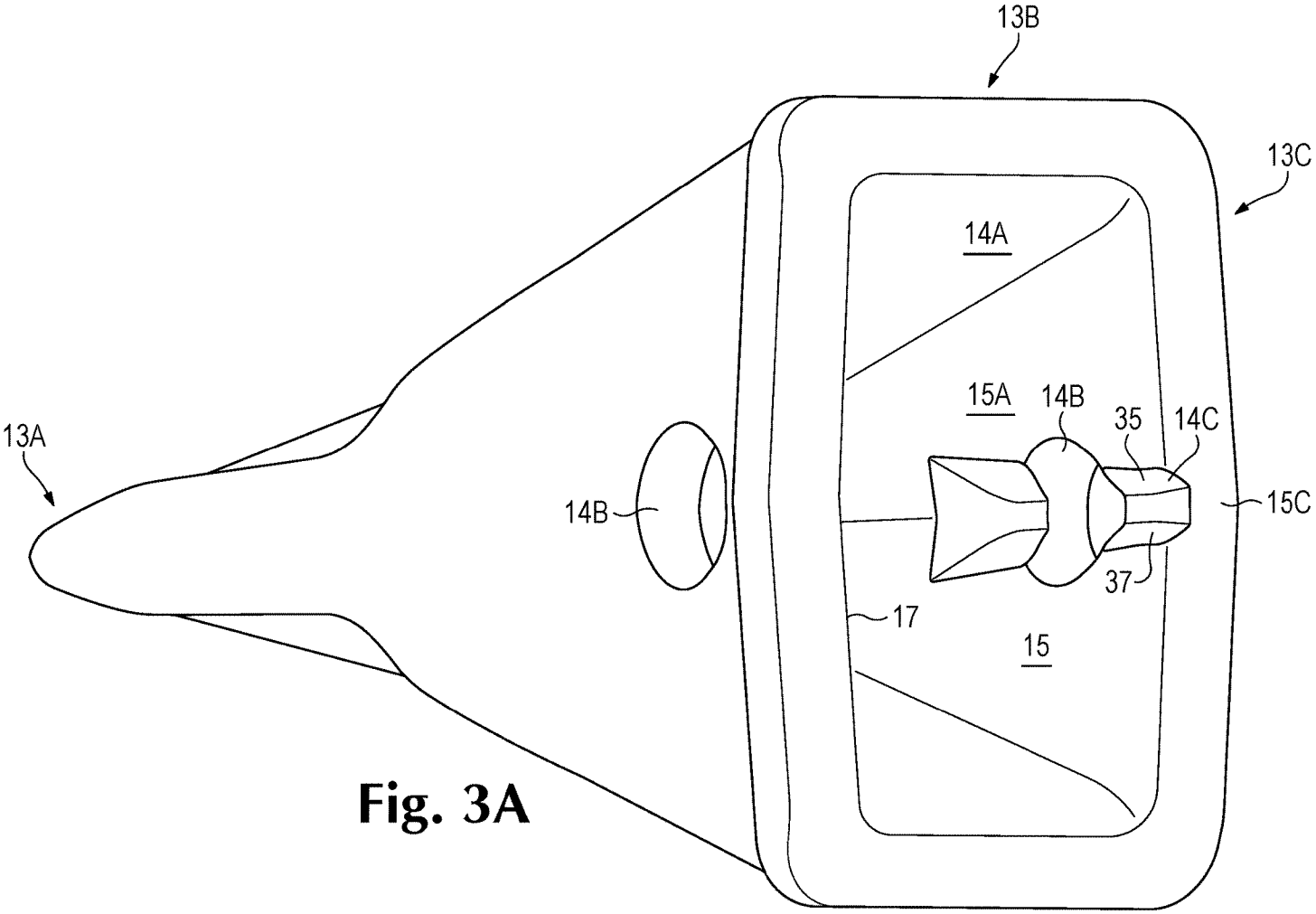
FIG. 3A is a rear perspective view of the wear member.

Retainer 20 includes a key 20A, which in this embodiment is a ridge that extends outward from the retainer to engage a keyway 14C, which in this embodiment is a slot in a cavity wall 15 of the wear member 14. As seen in FIGS. 3 and 3A, slot 14C extends generally parallel to axis LA of the wear member along an interior surface 15A of cavity wall 15. Keyway 14C could be oriented consistent with the direction of installation of the wear member on the base and not be parallel to axis LA. Slot 14C opens in and extends from the rear edge 15C to opening 14B to receive key 20A during installation of the wear member. In the illustrated construction, key 20A extends across the inner surface 20D of the retainer. Accordingly, the slot 14C continues forward of opening 14B to receive key 20A when the wear member is fully installed. In this position, key 20A axially sets forward and rearward of opening 14B. Nevertheless, the key could extend only partially across the retainer, in which case, the extension of the slot 14C forward of opening 14B could be less or non-existent. Key 20A is configured to be received in a slot 14C formed in the wall of cavity 14A of the wear member proximate opening 14B to prevent turning of the retainer.

Base 12 can optionally include a biasing element 24 to hold retainer 20 in recess 12B. The biasing element can be an elastomer that provides interference fit to frictionally keep the retainer. In this embodiment, biasing element 24 is fit into a recess in the wall of the adapter. The biasing element could also be fit into a recess formed in the retainer, in a wall of the recess 12B, for an inner liner of the recess 12B, or have other arrangements. The biasing element could have other configurations such as being annular to receive the retainer or be secured to the retainer. Alternatively, a magnet, an adhesive or other means can be used as a biasing element to hold the retainer 20.

Figure 5:
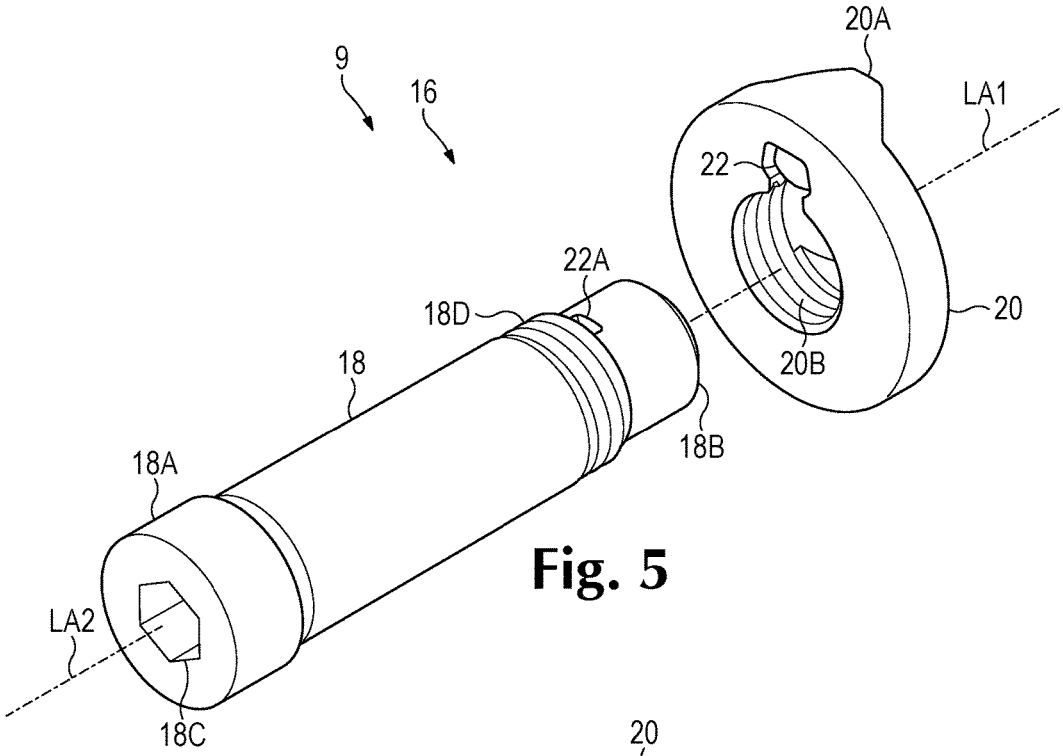
FIG. 5 is an exploded perspective view of an alternative lock for the wear assembly.
Figure 5A:
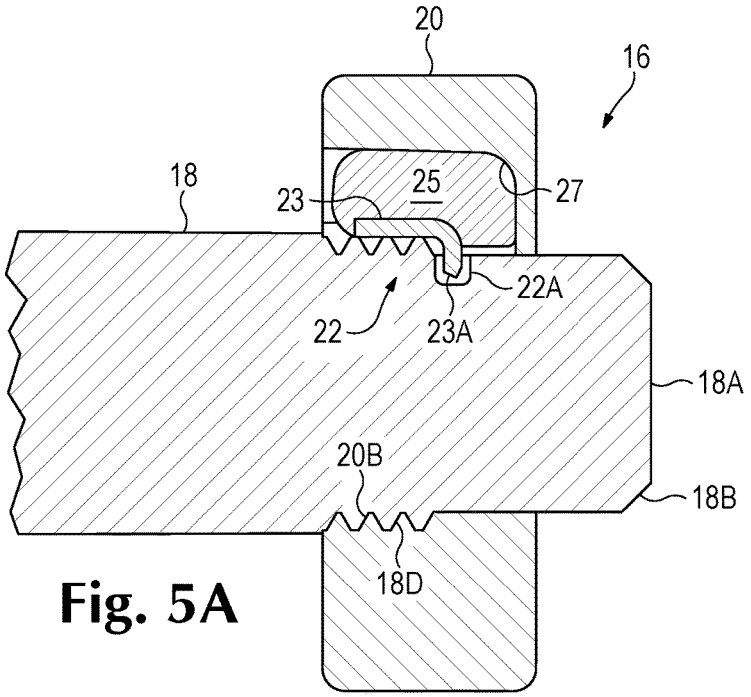
FIG. 5A a partial, axial cross section view of the alternative lock of FIG. 5.
Figure 6:
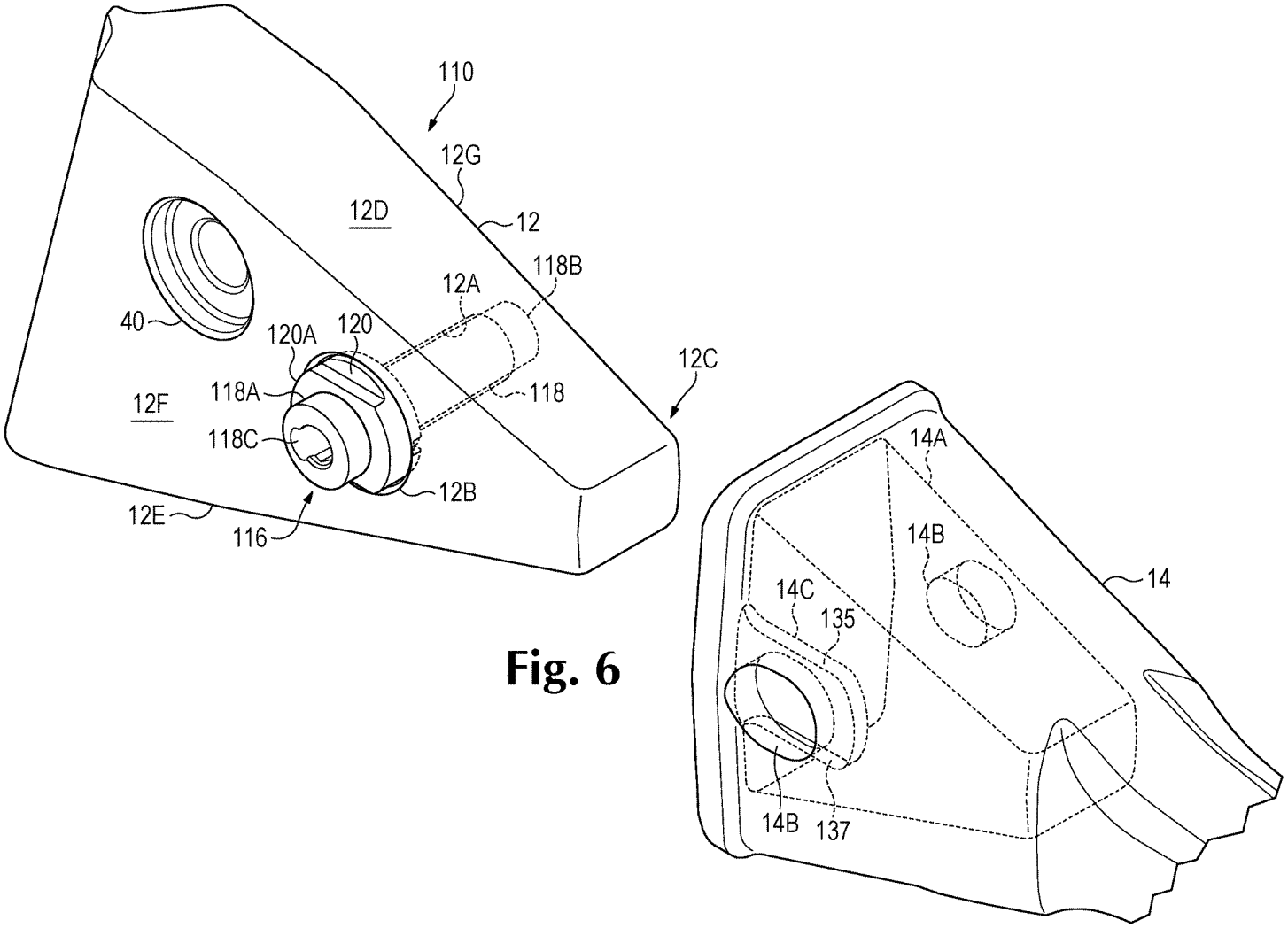
FIG. 6 is an exploded perspective view of a second embodiment of a wear assembly in accordance with the present invention.
Figure 7:
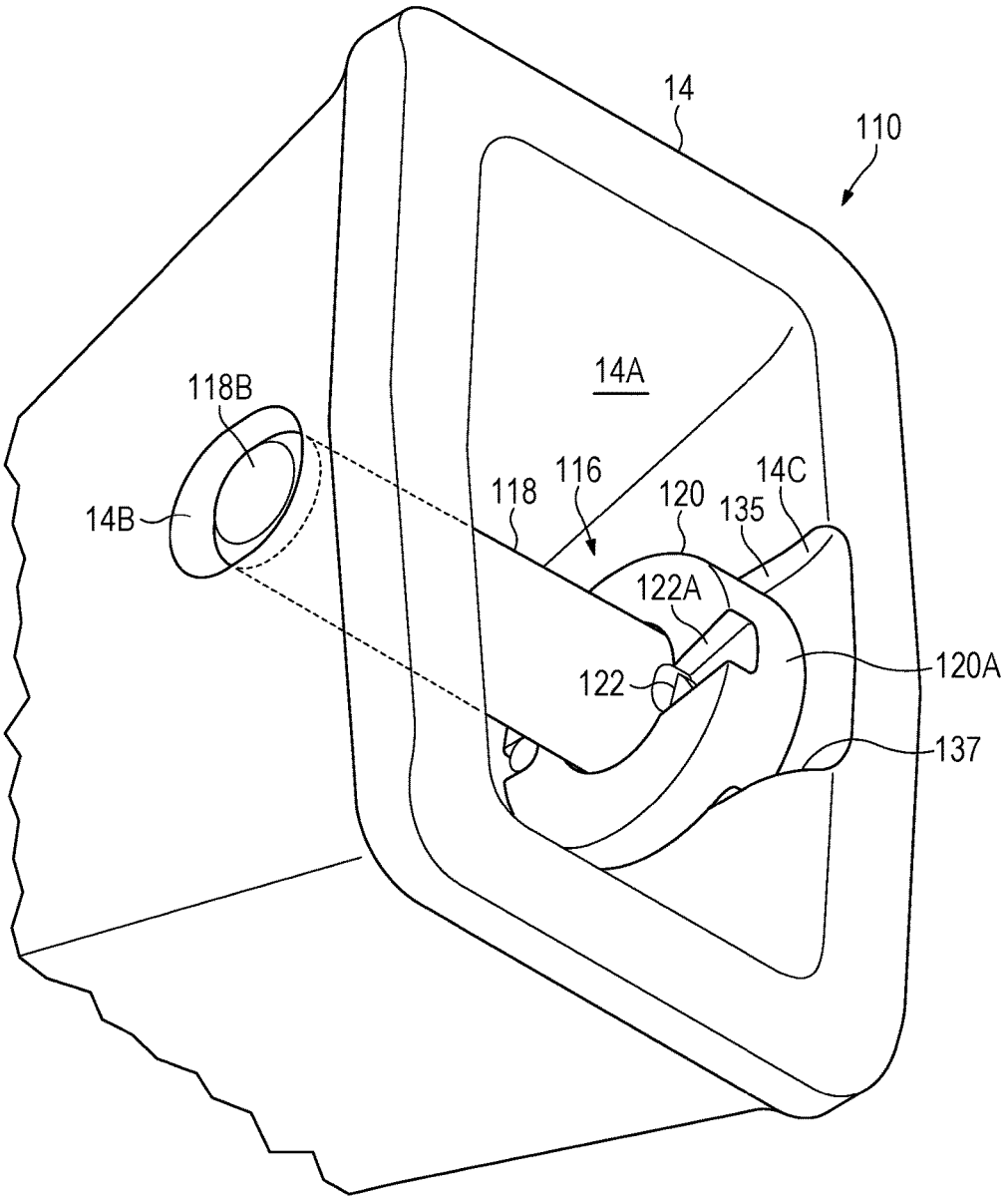
FIG. 7 is a rear perspective view of the wear member and lock of the second embodiment.
Figure 8:
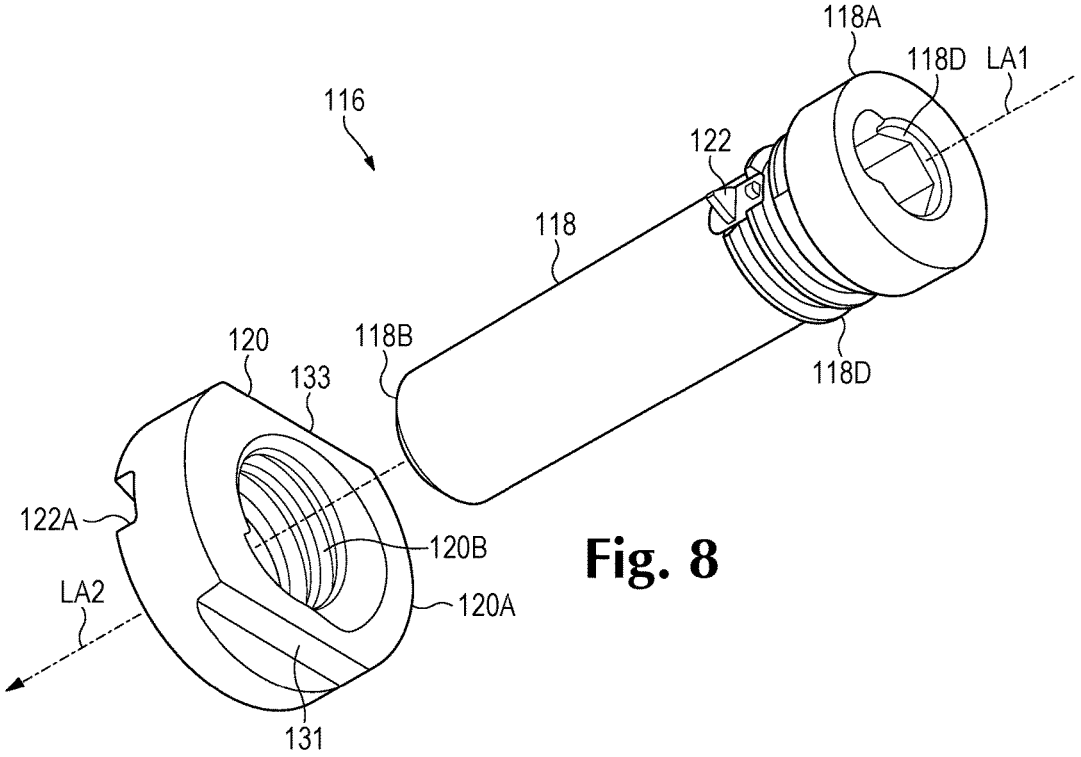
FIG. 8 is an exploded perspective view of the lock for the second embodiment.

The lock 16 can optionally include a keeper system to resist disengagement of the lock body 18 from the retainer 20 during operation. A latch or keeper 22 can be received in one of the retainer or the lock body to engage a keeper indentation 22A in a corresponding surface of the other body (FIGS. 5 and 5A). The keeper can include an extending engaging element, which may be elastomer, steel or other hard material fixed in an elastomer. The engaging element can deflect or displace under pressure and return to its original position. The extending engaging element engages a corresponding indentation 22A or latch recess with the lock body fully engaging the retainer. In this embodiment, keeper 22 includes a generally L-shaped metal tab 23 backed by a resilient block 25 which are fixed together and inserted into a recess 27 in retainer 20. As the lock body is installed in the retainer, the distal end of the lock body pushes the tab 23 outward against the bias of the resilient member until the inner end 23A of the tab snaps into indentation 22A. As seen in FIG. 5A, the distal end of the lock body preferably has a beveled edge 18B to ease tab 23 outward during initial installation.

Figure 4:
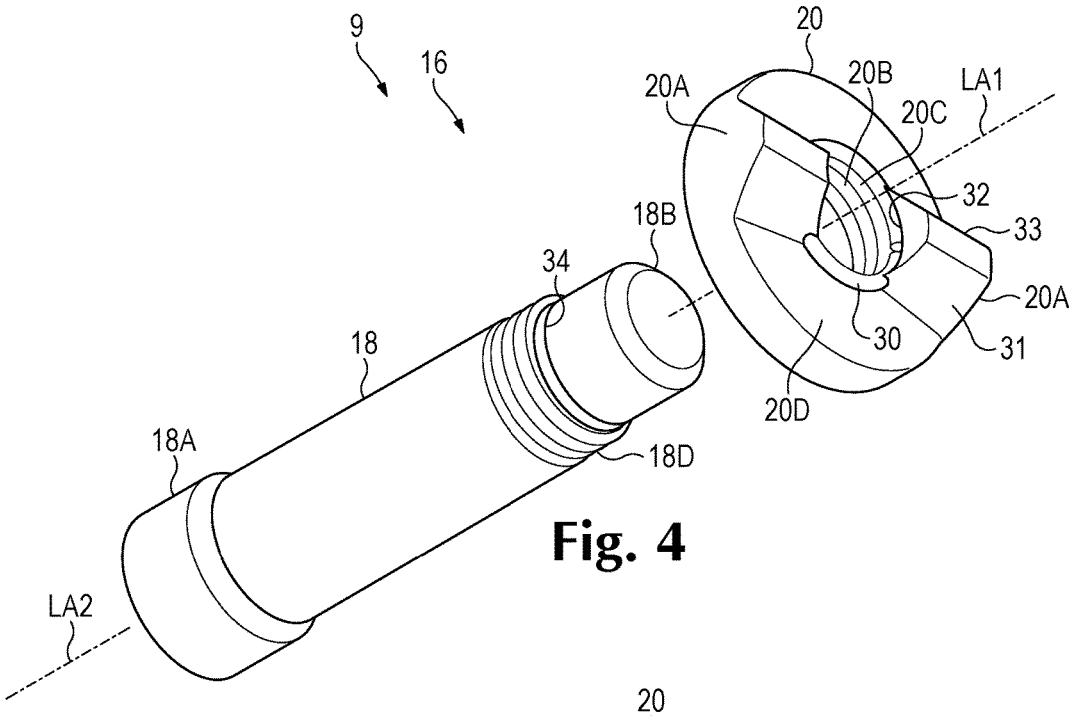
FIG. 4 is a perspective view of the lock.
Figure 4A:
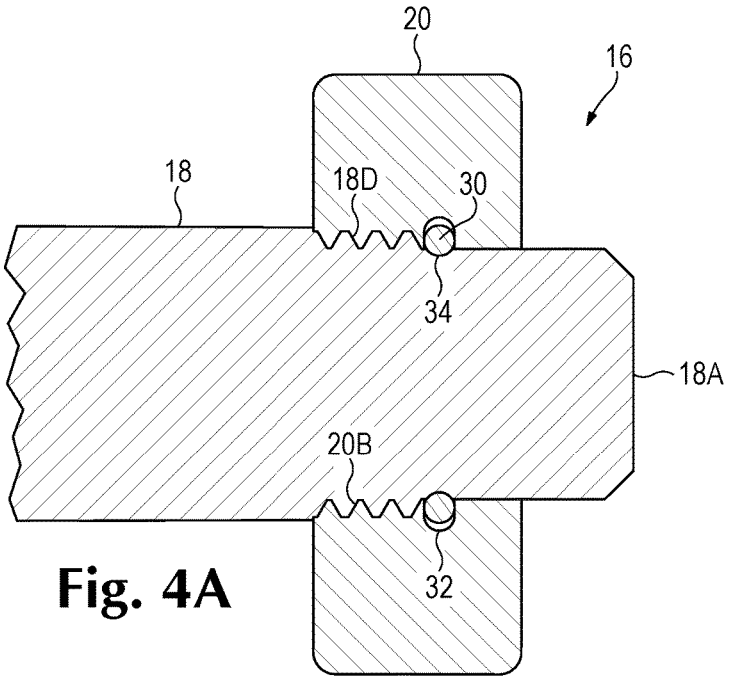
FIG. 4A partial, axial cross section view of the lock.

Alternatively, the keeper system can have other constructions. For example, the keeper system can include a split ring 30 retained by the retainer 20 (FIGS. 4 and 4A). The split ring can be retained in a first annular groove 32 in opening 20B allowing limited movement of the ring. As the lock body passes through the retainer opening 20B it will also pass through the ring. The ring expands to accept the lock body passing into the retainer. As the retainer engages the threads of the body it advances on the lock body with the ring until the ring engages a second annular groove 34 in the lock body. The split ring snaps into the second annular groove on the lock body. To extract the lock body from the retainer, additional torque is applied to again expand the ring to the full diameter of the lock body adjacent the recess. The keeper system limits axial movement of the retainer on the lock body to resist loosening, for example, on account of vibration and/or other forces, and maintain full engagement of the lock members. Other configurations of a keeper system that perform a similar function of inhibiting disengagement of the retainer from the lock body are possible.

Assembling the lock system includes inserting the retainer 20 into recess 12B of the adapter to engage biasing element 24. Key 20A extends outward beyond the base surface, which in this embodiment is sidewall 12F, with retainer 20 in the recess 12B. In one embodiment, the operator aligns key 20A for receipt into the slot 14C in the wear member cavity when the wear member is mounted on adapter 12. In another embodiment, the recess and retainer can be cooperatively formed (e.g., with a non-symmetric shape) to receive the retainer in a particular orientation to ensure key 20A is properly positioned to receive the slot. The base 12 is received in cavity 14A and key 20A is received in slot 14C as the wear member advances on the nose 12C. If the openings are not tapered, the slot could be formed in both sidewalls to permit assembly of the wear member in either orientation or to permit reversing of the wear member when partially worn. In the illustrated embodiment, the slot is formed in only one sidewall. Openings 12A align with openings 14B of the wear member 14 when the base is fully seated in the cavity. Recess 12B and slot 14C together form a retainer seat 26 for retainer 20. Retainer 20 sets in recess 12B between sidewall 12F of nose 12C and cavity wall 15 of wear member 14 when used with the conventional base, i.e., in the same location as the conventional split ring in a conventional tooth system.

Lock body distal end 18B is then inserted into opening 14B, opening 12A and the retainer until retainer threads 20C engage lock body threads 18D. Lock body 18 is then rotated to engage the corresponding threads adjacent distal end 18B and advances into the openings until proximal end 18A is recessed in wear member 12 and keeper 22 engages the corresponding keeper indentation 22A. Alternatively, the lock body could be installed in the opposite direction with the threads formed at the proximal end 18A to engage the retainer 20. Retainer 20 is prevented from rotating with lock body 18 by key 20A engaging keyway 14C. Disengagement of lock body 18 from retainer 20 is inhibited during operation by keeper system 22.

In the illustrated embodiment, key 20A is shown as a ridge extending axially along the retainer and tapering outward to define bearing surfaces 31, 33 to bear against corresponding bearing surfaces 35, 37 in keyway 14C. The bearing surfaces 31, 33, 35, 37 prevent rotation of retainer 20 during installation of lock body 18. Other key and keyway configurations are possible. For example, the key (e.g., a ridge) could be formed in the cavity wall, and the keyway (e.g., a slot) in the retainer. Also, as an example, the key could be non-symmetrical and narrower than the slot, and have a single bearing wall that extends along a complementary bearing wall on the slot to resist turning of the retainer. In general terms, the key and keyway can be each be referred to as rotation-resistant elements.

Lock body 18 can engage one opening 14B or can engage two openings 14B on opposing walls of cavity 14A. Lock body 18 extending through openings 14B and 12A resists movement of the wear member off the base. In the illustrated embodiment, the lock body is loaded in shear at one or both sides at the interface between the base and wear member to resist wear member loss during use. Other kinds of loading are possible depending on the fit and removal procedure of the wear member from the base. Axial movement of the lock body is limited by engagement of the threads of the retainer and lock body and, if provided, the keeper system.

To remove the lock, the lock body 18 is rotated by a tool to disengage the threads of the lock body from the threads of the retainer 20 and, if used, overcome the keeper. The lock body is removed from the openings. The wear member is removed from the adapter exposing the retainer 20 in recess 12B. A new wear member can then be installed on the base with the lock (or a new lock) inserted into the aligned openings 14B, 12A.

Wear assembly 110 is an alternative embodiment of a wear member and lock and operates in a similar way as described above. A wear member 14 receives a nose of base 12 in a rearward opening cavity 14A. The cavity includes a slot 14C and openings 14B. With the base seated in the wear member cavity, openings 14B align with opening 12A.

Lock 116 includes a retainer 120 and lock body 118 with a proximal end 118A preferably tapering to a distal end 118B, though the lock body could be untapered. Lock body 118 includes a tool engagement feature 118C such as an opening for an Allen head wrench or other torque tool. Retainer 120 includes a threaded opening 120B and key 120A. Key 120A in this embodiment is rectangular in cross section and corresponds in shape to keyway or slot 14C. Key 120A includes bearing surfaces 131, 133 that bear against corresponding bearing surfaces 135, 137 in keyway 14C. The bearing surfaces resist turning of the retainer 20 in recess 12B. The threads 118D are adjacent the proximal end 118A of the lock body in this embodiment but could be on the distal end. Wear assembly 110 can include a keeper system as previously described to limit disengagement of the lock body from the retainer.

Assembling the wear assembly 110 is similar to the previous embodiment and includes inserting the retainer 120 into recess 12B and engaging biasing element 24. Key 120A extends beyond the base surface. Base 12 is received in cavity 14A as wear member 14 advances onto the base with key 120A being received in keyway 14C. Opening 12A aligns with openings 14B as the wear member seats on the base and the keyway is adjacent recess 12B with the retainer held by the keyway and recess. Lock body distal end 118B is inserted into opening 14B adjacent retainer 120, through retainer 120 and opening 12A, and into opening 14B opposite retainer 120. The retainer threads 120B engage threads 118D during installation of lock body 118. Lock body 118 rotates to engage the threads of the retainer and advances into the openings until proximal end 118A is recessed in wear member 14 and keeper 122 engages the corresponding indentation 122A. Again, the retainer is prevented from rotating with the advancing lock body by the engagement of the key with the keyway. As with the earlier embodiment, the key (e.g., ridge) could be formed in the cavity wall of the wear member and the keyway (e.g., slot) in the retainer.

The locks described herein provide systems for securing wear members to earth working equipment. These lock can resist binding from fines, accidental loss of the wear member during operations, and/or rapid replacement of the wear member and installation of replacement part at the end of its service life reducing operating costs.

The above disclosure describes specific examples of locks for securing wear members to excavating equipment that include different aspects or features of the invention. The various inventive features are preferably used together in ways as described in the embodiments. Nevertheless, the various features can be used alone or in other combinations and still gain certain benefits of the invention. This could be the case for each of the inventive features disclosed. Also, features in one embodiment can be used with features of the other embodiment. The examples given and the combination of features disclosed are not intended to be limiting in the sense that they must be used together.

The invention claimed is:

1. A wear assembly for earth working equipment, the wear assembly comprising:

a ground-engaging wear member including (i) a cavity having top, bottom and side walls for receiving a base on the earth working equipment, the base having an opening extending transversely through the base and a recess surrounding the opening on one wall of the base, (ii) a hole in each said sidewall, and (iii) a slot in at least one of the side walls of the cavity; and a lock including a retainer received in the recess in the base, and a lock body, the retainer having a central opening generally aligned with the opening in the base and a key received into the slot, the lock body extending through the central opening in the retainer and into each hole in the wear member to hold the wear member to the base, and the lock body and central opening having fastening elements that engage each other to connect the lock body to the retainer and the fastening elements are engaging threads.

2. The wear assembly of claim 1 where the slot includes a pair of spaced bearing surfaces to bear against complementary surfaces on the key to prevent turning of the retainer in the recess.

3. The wear assembly of claim 1 where the slot includes a pair of spaced bearing surfaces to bear against complementary surfaces on the key and the bearing surfaces are parallel.

4. The wear assembly of claim 1 where the slot extends into the cavity forward of the hole.

5. The wear assembly of claim 1 where the lock body is tapered along its length.

6. The wear assembly of claim 1 where a keeper system inhibits unintended movement of the lock body in relation to the retainer during use.

* * * * *